US009845682B2

(12) United States Patent
Maguire et al.

(10) Patent No.: US 9,845,682 B2
(45) Date of Patent: Dec. 19, 2017

(54) FAN DISC

(71) Applicant: ROLLS-ROYCE PLC, London (GB)

(72) Inventors: Alan R Maguire, Derby (GB); Kenneth F Udall, Derby (GB); Phillip J Doorbar, Derby (GB)

(73) Assignee: ROLLS-ROYCE plc, London (GB)

( * ) Notice: Subject to any disclaimer, the term of this patent is extended or adjusted under 35 U.S.C. 154(b) by 282 days.

(21) Appl. No.: 14/709,883

(22) Filed: May 12, 2015

(65) Prior Publication Data

US 2015/0377027 A1 Dec. 31, 2015

(30) Foreign Application Priority Data

May 19, 2014 (GB) ..... 1408824.9

(51) Int. Cl.

| | |
|---|---|
| ***F01D 5/32*** | (2006.01) |
| ***F01D 5/02*** | (2006.01) |
| ***F01D 5/30*** | (2006.01) |
| ***F01D 25/16*** | (2006.01) |

(52) U.S. Cl.

CPC ..... *F01D 5/025* (2013.01); *F01D 5/3007* (2013.01); *F01D 25/164* (2013.01); *F05D 2220/36* (2013.01)

(58) Field of Classification Search

CPC ..... F01D 5/025; F01D 5/3007; F01D 25/164; F01D 5/326; F02C 7/36; F02C 7/32

See application file for complete search history.

(56) References Cited

U.S. PATENT DOCUMENTS

| | | | | |
|---|---|---|---|---|
| 5,112,193 | A * | 5/1992 | Greer | F01D 5/3015 416/220 R |
| 6,951,448 | B2 * | 10/2005 | Duesler | F01D 5/326 416/220 R |
| 8,449,260 | B2 * | 5/2013 | Xie | F01D 5/06 416/189 |
| 9,004,849 | B2 * | 4/2015 | Munsell | F01D 25/16 415/1 |

FOREIGN PATENT DOCUMENTS

| | | |
|---|---|---|
| GB | 1 215 300 A | 12/1970 |
| GB | 1 556 266 A | 11/1979 |

OTHER PUBLICATIONS

Dec. 23, 2014 Search Report issued in British Application No. 1408824.9.

* cited by examiner

*Primary Examiner* — Woody Lee, Jr.
*Assistant Examiner* — Sabbir Hasan
(74) *Attorney, Agent, or Firm* — Oliff PLC

(57) ABSTRACT

A fan disc is provided for supporting fan blades of a gas turbine engine. The fan disc has a disc body having axially extending slots for receiving, in use, dovetail root fixings of a circumferential row of fan blades. The fan disc further has an annular drive arm which extends radially inwardly from a forward portion of the disc body to a connector for engaging, in use, with a corresponding connector portion of a drive shaft of the engine. The fan disc further has a hoop stiffening ring which is removably mounted to a rear portion of the disc body, the stiffening ring being axially spaced from the drive arm to increase the torsional stiffness of the fan disc.

12 Claims, 8 Drawing Sheets

FAN DISC

FIELD OF THE INVENTION

The present invention relates to a fan disc for supporting fan blades of a gas turbine engine

BACKGROUND OF THE INVENTION

FIG. 1 shows a conventional aero engine fan rotor and front bearing housing arrangement.

A fan disc 100 supports a circumferential row of fan blades 102. The disc requires torsional stiffness to resist the 2D vibration mode of the fan rotor. This torsional stiffness is provided by front 104 and rear 106 axially spaced diaphragms which have differential hoop bending stiffnesses. An optional middle diaphragm 108 may be provided to produce a more even radial load distribution across the fan blade root fixings.

The disc 100 has a rear drive arm 110 which extends to a bolted joint with the engine's fan shaft 112.

A front bearing arrangement including a housing 114 and a front set of ball bearings 116 and a rear set of roller bearings (not shown), support and locate the fan shaft.

The front set of bearings 116 is axially offset a distance O rearwards from the centre of gravity C of the fan blades 102. This results in a large overhung fan mass having a relatively low first order vibration frequency with large vibrational amplitudes and high restoring forces.

Very large forces are generated during a fan blade off (FBO) event, producing a large bending moment in the fan shaft 112 due to the FBO force and the axial offset O of the front bearing. This bending moment is reacted at the bearings 116 along with the direct forces.

The rear drive arm 110 is relatively long, its length being determined by the relative fan disc 100 to bolted joint radial growth in order to provide an amount of isolation to the bolted joint. The length of the arm causes the front set of bearings 116 to be pushed further away from the fan blade centre of gravity C. Moreover, because of the large FBO loads experienced by the bearings 116, the arm 110 has to be oversized to ensure structural integrity.

The already expensive fan disc forging is thus made even more expensive by its accommodation of a long and oversized rear drive arm 110.

An alternative to a bolted joint for connecting the fan disc to the fan shaft is to use a splined joint, as proposed in GB 1556266 and GB 1215300. However, in such spline drive fan discs, the support structure of the foremost bearing and the bearing envelope interferes with the space available for the conventional fan disc rear diaphragm. Consequently, fan disc torsional stiffness is reduced, increasing the risk of coincidence of the 2D fan rotor frequency with an engine order forcing frequency. Also, during FBO, conventional front and rear disc diaphragms provide structural strength to the disc to resist hoop bending distortion and prevent potential disc burst from excessive localised hoop stress in the disc bore.

SUMMARY OF THE INVENTION

It would be desirable to provide a fan disc which addresses the problems discussed above.

Accordingly, in a first aspect, the present invention provides a fan disc for supporting fan blades of a gas turbine engine, the fan disc having:

a disc body having axially extending slots for receiving, in use, dovetail root fixings of a circumferential row of fan blades; and an annular drive arm which extends radially inwardly from a forward portion of the disc body to a connector for engaging, in use, with a corresponding connector portion of a drive shaft of the engine;

wherein the fan disc further has a hoop stiffening ring which is removably mounted to a rear portion of the disc body, the stiffening ring being axially spaced from the drive arm to increase the torsional stiffness of the fan disc.

Advantageously, by combining the features of a drive arm at the front which extends to a connector and a removably mounted hoop stiffening ring at the rear, the disc can have sufficient torsional stiffness while the fan front bearing can be moved forward, e.g. so that it is coincident with the centre of gravity of the fan. In this way, the fan to bearing overhang can be eliminated, hence the large FBO bending moment can also be eliminated. The improved FBO situation means that the bearing no longer experiences such a large FBO shear force and bending moment, and a smaller fan front bearing can be adopted. In addition, the vibration characteristics of the fan rotor can be improved in that the natural frequency is higher and the amplitude of vibrations is reduced. Furthermore, the arrangement enables a smaller lower cost fan disc forging to be produced to support the fan blades.

In a second aspect, the present invention provides a gas turbine engine having a circumferential row of fan blades supported by the fan disc of any one of the first aspect, the axially extending slots of the fan disc receiving dovetail root fixings of the fan blades, and the connector of the drive arm of the fan disc engaging with a corresponding connector portion of a fan drive shaft of the engine.

The gas turbine engine may further have a front bearing arrangement radially locating and supporting the fan drive shaft, the front bearing arrangement having a front bearing housing and a set of rotatable bearing members (e.g. a set of ball or roller bearings) which is positioned in the housing axially between the connector portion and the hoop stiffening ring. For example, the set of rotatable bearing members can be approximately axially coincident with the fan centre of gravity. The gas turbine engine may be a geared turbofan engine, the drive shaft being split into a front portion which provides the connector portion and a rear portion which connects to a low-pressure turbine of the engine, the front and rear portions being operatively connected to each other via a power gearbox, wherein the gearbox is located in the front bearing housing. Geared turbofans can provide fuel burn benefits through improved specific thrust, and also a significant noise benefit due to slow speed fan. However, geared fan systems generally require a large space envelope to accommodate the power gearbox. Moving the fan front bearing forwards in conjunction with a front drive arm for the fan disc provides an opportunity to accommodate the power gearbox in the front bearing housing without increasing engine length relative to a direct drive fan system.

Optional features of the invention will now be set out. These are applicable singly or in any combination with any aspect of the invention.

The drive arm may be frustoconical in shape, i.e. tapering forwardly as it extends radially inwardly to the connector.

The connector may be a splined connector for engaging, in use, with a correspondingly splined connector portion of the drive shaft. Another option, however, is for the connector to be a flange bolted connector for engaging, in use, with a corresponding flanged portion of the drive shaft. According to this option, the flange bolted connector and corresponding flanged portion may have teeth which interlock across the flange joint to enhance torque transfer, e.g. in the form of a curvic or Hirth coupling. Additionally or alternatively, the connector and the drive shaft may have interconnecting locating spigot surfaces to enhance torque transfer between the connector and the shaft.

The stiffening ring may be formed of composite material. For example, it may be formed of a metal matrix composite material, such as titanium alloy metal matrix composite or aluminium alloy metal matrix composite. Another option is to form it of a fibre-reinforced polymer composite. Titanium alloy metal matrix composite, in particular, has a relatively high temperature capability. Such composites can combine high stiffness with high specific stiffness.

The disc body typically has dovetail root fingers at an outer side thereof which define flanks of axially extending slots. The stiffening ring may then project radially outwardly beyond the outermost surfaces of the dovetail root fingers. By extending radially outwardly further than conventional disc diaphragms, the torsional stiffness of the disc can be improved The disc body may have an aft portion which projects rearwardly of the rear ends of the dovetail root fixings of the fan blades, the stiffening ring being removably mounted to an outer side of the aft portion. According to another option, however, the disc body has dovetail root fingers at an outer side thereof which define flanks of axially extending slots; and the disc body may then have an aft portion formed by a circumferential row of radially outward projections from rear ends of the dovetail root fingers, the stiffening ring being removably mounted to a rear side of the aft portion. Either way, conveniently the stiffening ring may be removably mounted to the aft portion by a row of bolts threaded into axially extending bolt holes formed in the aft portion.

The fan disc may further have an annular seal panel attached to or integrally formed with the hoop stiffening ring, the seal panel extending from the stiffening ring to a radially-outward air-washed portion of the seal panel adjacent the trailing edges of the fan blades.

Conveniently, the stiffening ring may have a row of forward facing support formations (e.g. pins) which, in use, support corresponding engagement portions of a row of annulus fillers located in the gaps between adjacent fan blades. Typically, such annulus fillers have lids which provide air-washed surfaces extending between the adjacent fan blades. The downstream edge of each lid can cooperate with the air-washed portion of a seal panel of the disc. For example, each lid may have a rear lip which hooks under a forward edge of the air-washed portion.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES OF THE INVENTION

Figure 1:
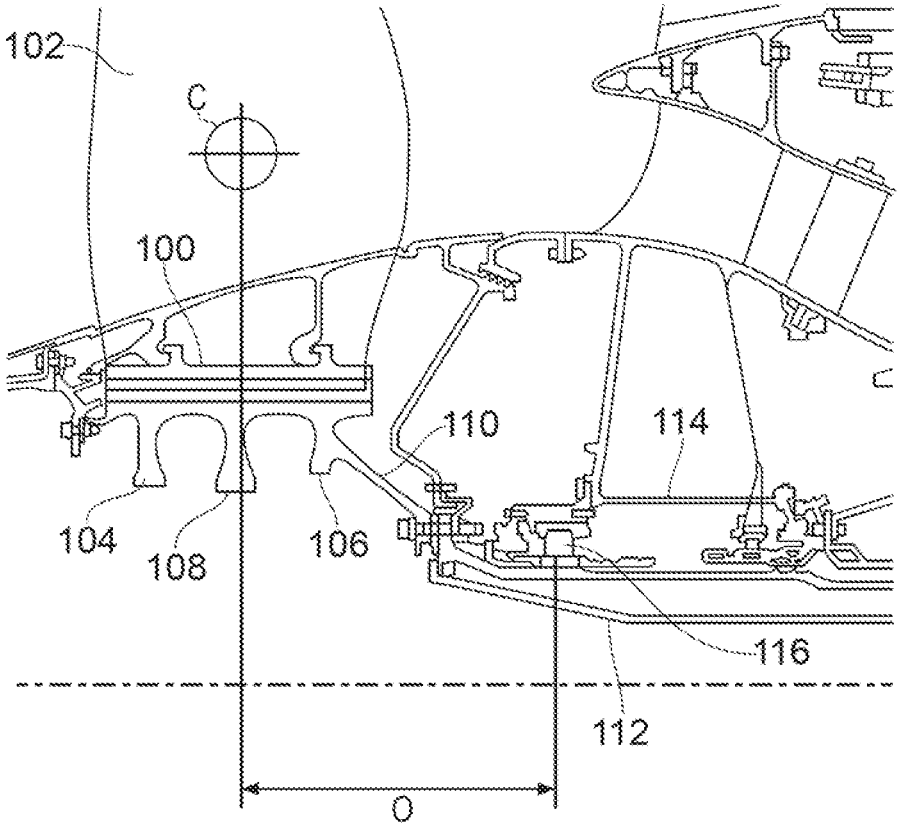
FIG. 1 shows a conventional aero engine fan rotor and front bearing housing arrangement.
Figure 2:
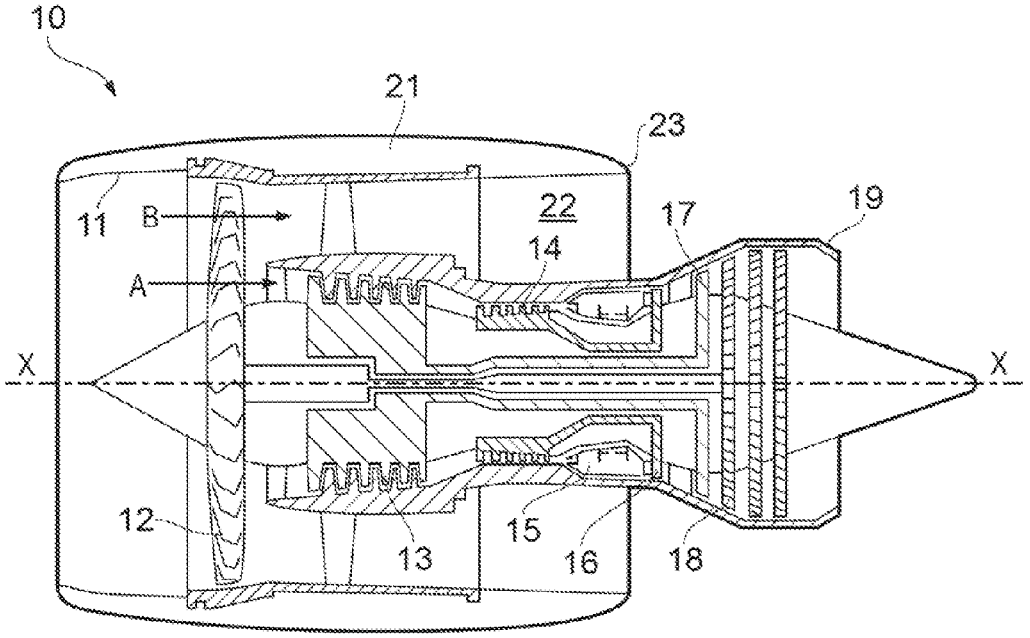
FIG. 2 shows a longitudinal cross-section through a ducted fan gas turbine engine.

With reference to FIG. 2, a ducted fan gas turbine engine incorporating the invention is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate-pressure compressor 13 and a second air flow B which passes through the bypass duct 22 to provide propulsive thrust. The intermediate-pressure compressor 13 compresses the air flow A directed into it before delivering that air to the high-pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate-pressure compressors 14, 13 and the fan 12 by suitable interconnecting drive shafts.

Figure 3:
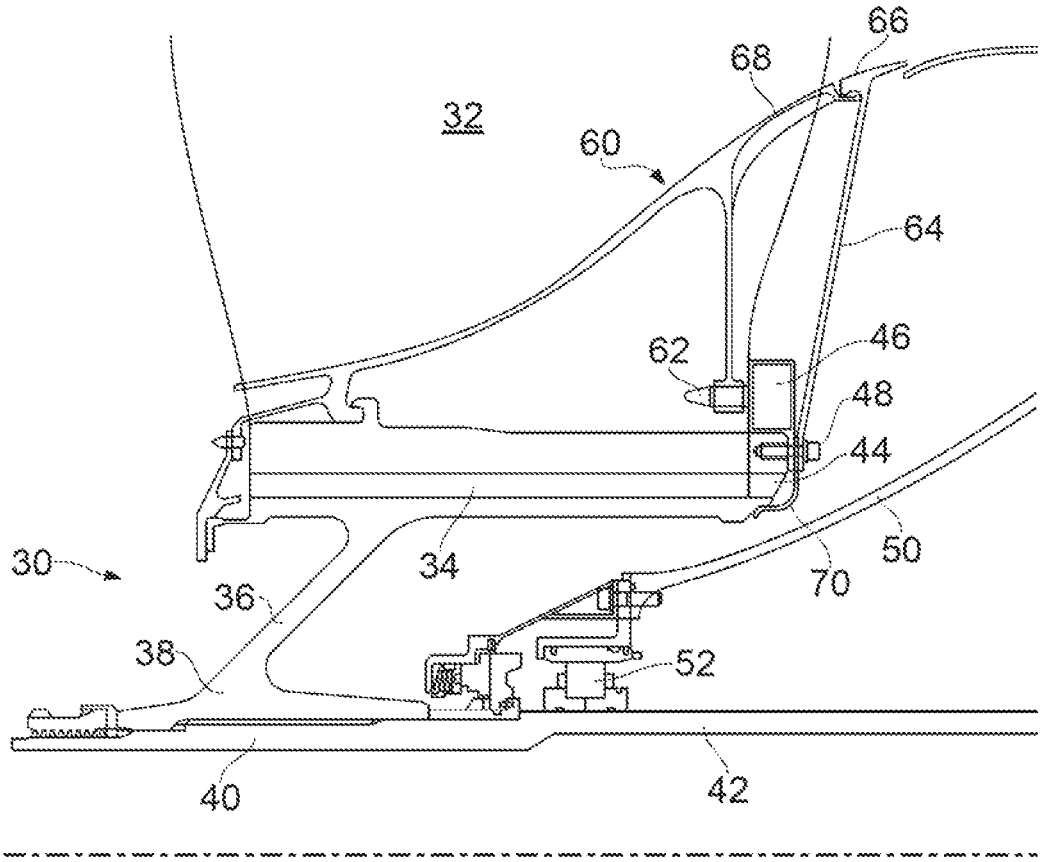
FIG. 3 shows a side view of the fan disc of the engine of FIG. 2.

FIG. 3 shows a side view of the fan disc 30 of the engine 10. The fan disc supports a circumferential row of fan blades 32. The disc body 34 has axially extending slots which receive the dovetail root fixings of the blades. A frustoconical drive arm 36 tapers forwardly from a forward portion of the disc body to a splined connector 38 which engages with a corresponding splined connector portion 40 of the fan shaft 42 of the engine.

The fan shaft 42 has a front bearing arrangement including a bearing housing 50 and a front set of roller bearings 52. The forward position of the splined connector portion 40, allows these bearings to be axially located close to fan centre of gravity, eliminating front overhang, and hence eliminating large FBO shear forces and bending moments. Smaller bearings can thus be used. In addition, the vibration characteristics of the fan rotor can be improved, in that the natural frequency is much higher and the amplitude of vibrations is reduced. However, there is now a space conflict at the rear underside of the fan disc 30, where there is no longer sufficient room to provide a rear diaphragm.

Accordingly, the disc body 34 has an aft portion 44 which extends rearwardly of the rear ends of the dovetail root fixings of the blades 32. A hoop stiffening ring 46 is mounted via a close fitting spigot surface over the outer diameter of the aft portion. A row of bolts 48 threaded into axially extending bolt holes formed in the aft portion secure the stiffening ring to the disc body, and also allow it to be removed therefrom. The stiffening ring in conjunction with the axially spaced drive arm 36 provides sufficient disc torsional stiffness (2D vibration) and structural strength in the event of FBO. Advantageously, the increased axial extension of the disc body enhances the torsional stiffening effect on the fan rotor.

As a result of these changes, the fan disc forging envelope can be made significantly smaller, and thus lower cost, than an equivalent conventional disc envelope.

Figure 4A:
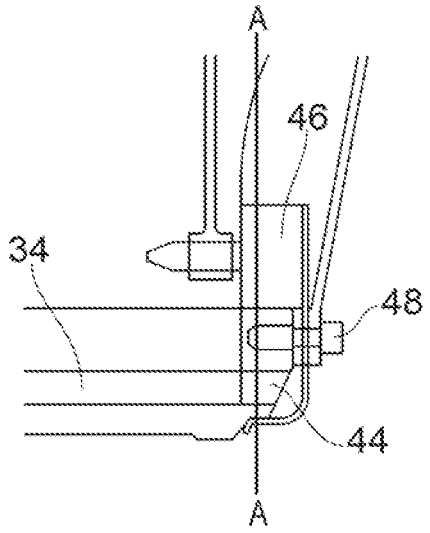
FIG. 4A shows a close up view of the rear of the fan disc of FIG. 3, with a section A-A indicated.
Figure 4B:
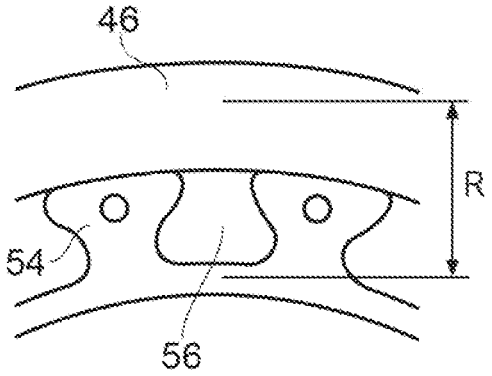
FIG. 4B shows a view of the fan disc along section A-A.
Figure 4C:
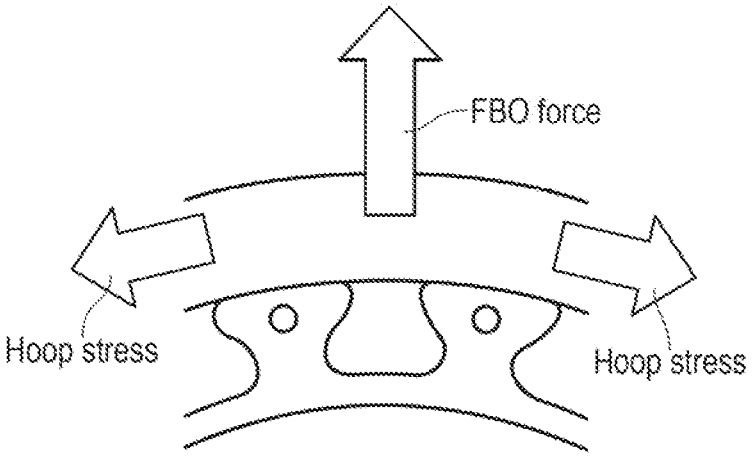
FIG. 4C shows a further view of the fan disc along section A-A.

FIG. 4A shows a close up view of the rear of the fan disc 30, with a section A-A indicated, FIG. 4B shows a view of the fan disc along section A-A, and FIG. 4C shows a further view of the fan disc along section A-A. The disc body 34 has dovetail root fingers 54 at its outer side which define the flanks of the axially extending slots 56 for receiving the dovetail root fixings of the blades. The stiffening ring 46 provides extra support to the dovetail root fingers during normal engine operation. It also helps to prevent disc polygonising distortions. With reference to FIG. 4B, the second moment of area for torsional stiffness is provided by a combination of the stiffening ring plus the fan disc rim 58 with radial separation R connected through the dovetail root disc fingers. This arrangement utilises the same principle as I-beam sections to maximise the stiffness improvement within an available space envelope. With reference to FIG. 4C, the stiffening ring additionally provides extra hoop stress support during FBO events.

Referring again to FIG. 3, annulus fillers 60 are located in the gaps between adjacent blades 32. Conventionally such fillers can be fitted to a fan disc by front and rear hooks formed on the outer surface of the disc. Conveniently, however, the stiffening ring can provide a row of formations, such as pins 62, for supporting corresponding engagement portions of the fillers. This avoids the high cost of providing the rear hook within the fan disc forging envelope.

The fan disc 30 may have a an annular seal panel 64 which extends from the stiffening ring 46 to a radially-outward air-washed portion 66 of the seal panel adjacent the trailing edges of the fan blades. Conveniently, the bolts 48 which secure the stiffening ring can also secure the seal panel. The annulus fillers 60 have lids 68 which provide air-washed surfaces extending between the adjacent fan blades. Each lid has a rear lip which hooks under a forward edge of the air-washed portion 66 of the seal panel.

A sealing ring 70, e.g. formed of sheet metal, can also be attached at the bolts 48 to cover the aft ends of the axially extending slots 56.

The stiffening ring 46 can be produced using a composite material such as titanium alloy metal matrix composite (TiMMC). This has a high specific stiffness which therefore increases torsional stiffness while reducing the extra weight of the ring.

Figure 5A:
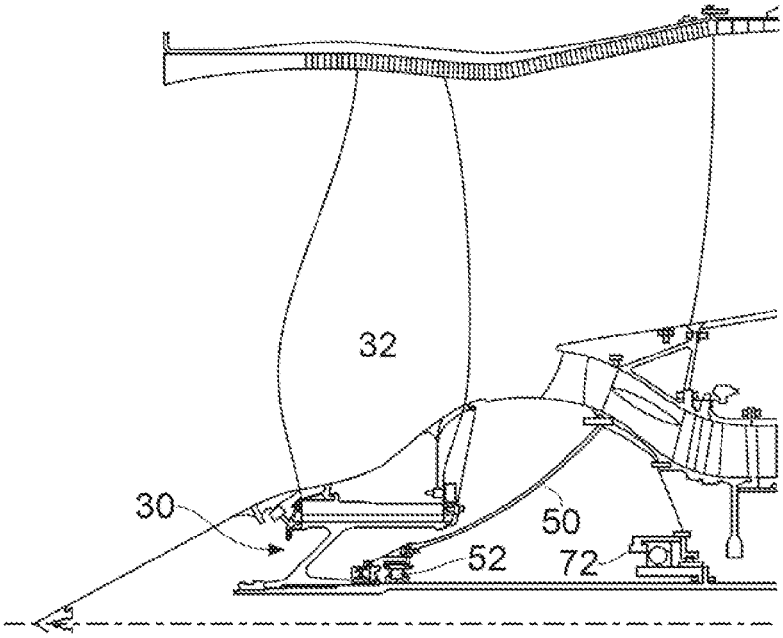
FIG. 5A shows a view of the fan disc of FIG. 3 and the entire front bearing arrangement.
Figure 5B:
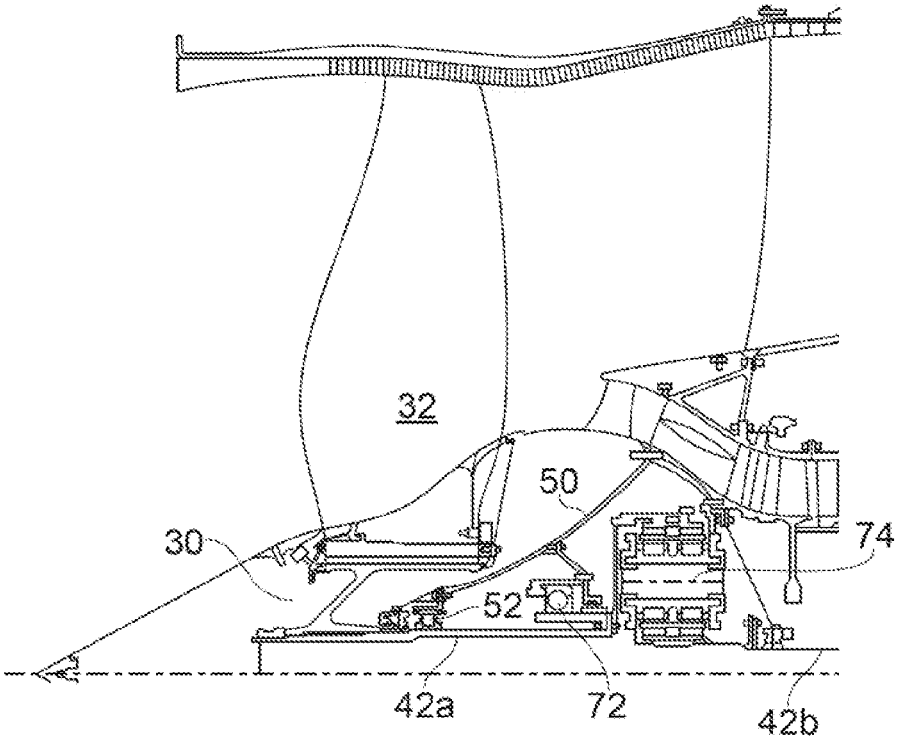
FIG. 5B shows an adaptation of the engine in which the fan shaft is split into a front portion and a rear portion operatively connected to each other via a power gearbox.

FIG. 5A shows a view of the fan disc 30 and the entire front bearing arrangement, including the bearing housing 50, the front set of roller bearings 52 and a rear set of ball bearings 72. Advantageously, the disc configuration allows a power gearbox to be incorporated into the engine in the bearing housing without any increase in engine length. In particular, FIG. 5B shows an adaptation of the engine of FIG. 5A in which the fan shaft is split into a front portion 42*a* and a rear portion 42*b* operatively connected to each other via a power gearbox 74 located in the housing behind the rear set of ball bearings.

Figure 6A:
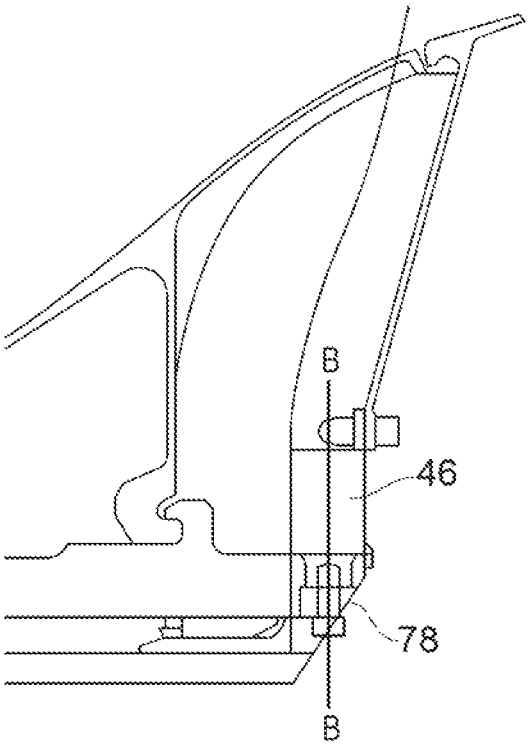
FIG. 6A shows a close up view of the rear of a variant of the fan disc of FIG. 3, with a section B-B indicated.
Figure 6B:
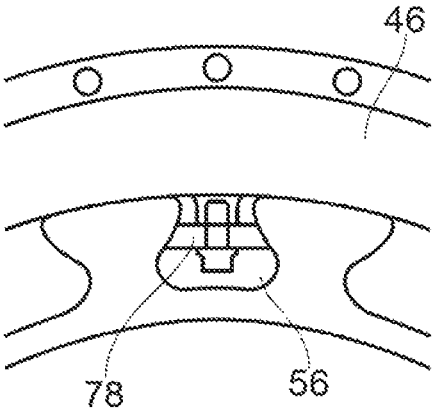
FIG. 6B shows a view of the fan disc along section B-B.

FIG. 6A shows a close up view of the rear of a variant of the fan disc 30, with a section B-B indicated, and FIG. 6B shows a view of the fan disc along section B-B. This variant utilises the dovetail profile of the axially extending slots 56 in the aft portion of the disc body to provide a location for an internal clamp 78 to locate the stiffening ring 46. A re-entrant formation may also be provided to enhance axial retention of the ring.

Figure 7A:
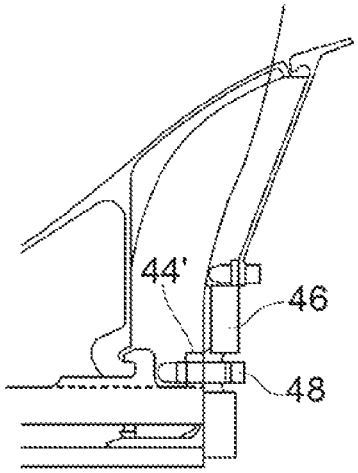
FIGS. 7A, 7B and 7C show respective close up views of the rear of a fan disc to illustrate alternative methods of mounting a stiffening ring to the disc.
Figure 7B:
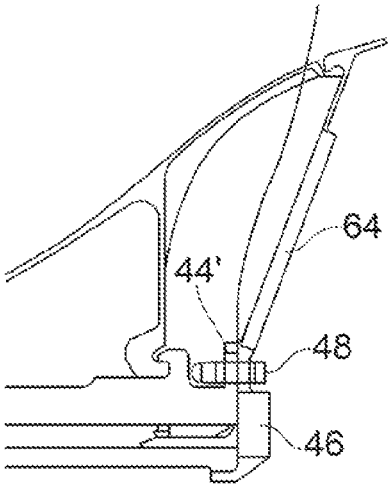
Figure 7C:
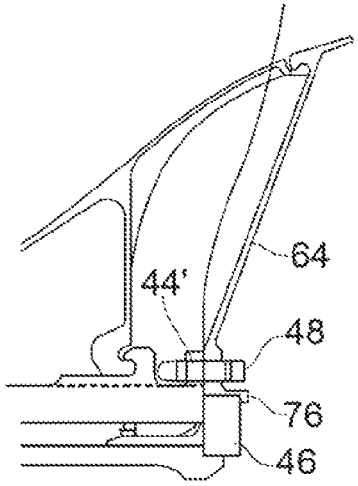

FIGS. 7A, 7B and 7C show respective close up views of the rear of a fan disc to illustrate alternative methods of mounting a stiffening ring 46 to the disc. None of the alternative methods requires an aft portion 44 extending rearwardly of the rear ends of the dovetail root fixings. Instead they each have an aft portion 44' in the form of a circumferential row of radially outward projections from the rear ends of the dovetail root fingers.

In FIG. 7A, the stiffening ring 46 is in the form of a double ring to provide increased stiffness capability. The ring is removably mounted by bolts 48 to a rear side of the aft portion 44'.

In FIG. 7B, the stiffening ring 46 is integrated with the seal panel 64 to provide an enhanced stiffening effect. Again the integral ring and panel is removably mounted by bolts 48 to a rear side of the aft portion 44'. In this case, an aluminium alloy metal matrix composite may be more suitable for forming the ring and panel.

In FIG. 7C, the stiffening ring 46 is clamped to the fan disc 30 by an extension 76 from the seal panel 64.

Figure 8:
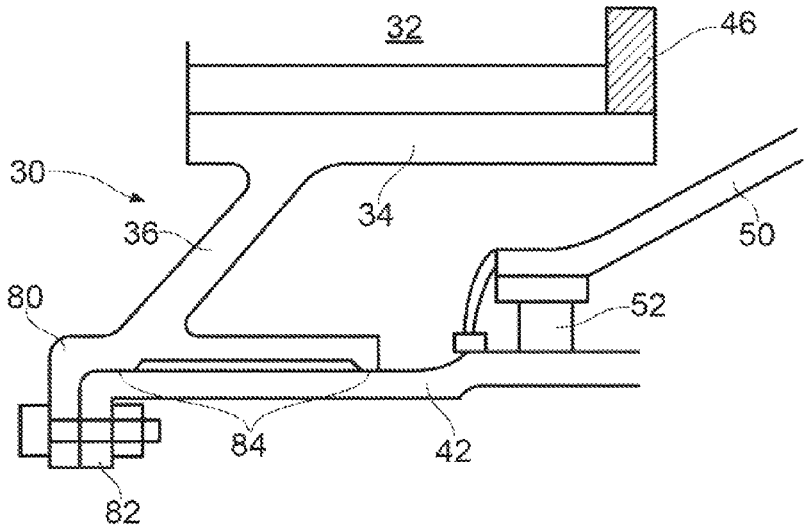
FIG. 8 shows a close up view of a further variant of the fan disc of FIG. 3.

FIG. 8 shows a close up view of a further variant of the fan disc of FIG. 3. In this variant, instead of a splined connector, the drive arm 36 has a plain faced, flanged connector 80 which bolts to a corresponding flanged portion 82 of the fan shaft 42. To provide additional torque transfer capability between the connector and the shaft, locating spigot surfaces 84 are formed on the connector and the shaft.

Figure 9A:
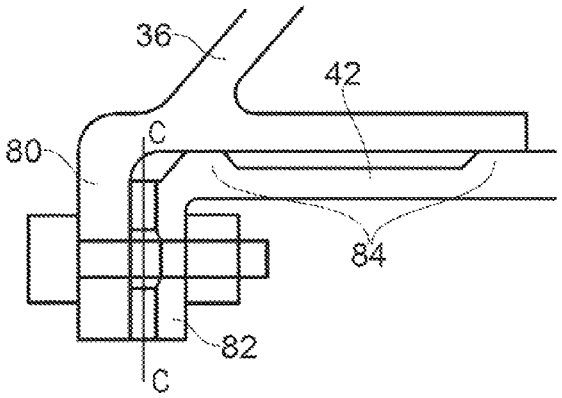
FIG. 9A shows a close up view of the connector of another variant of the fan disc of FIG. 3, with a section C-C indicated.
Figure 9B:
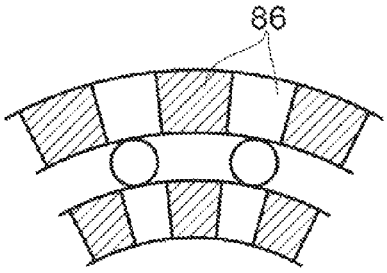
FIG. 9B shows a view of the joint along section C-C.

FIG. 9A shows a close up view of the connector of another variant of the fan disc of FIG. 3, with a section C-C indicated, and FIG. 9B shows a view of the joint along section C-C. In this variant, the flanged connector 80 and the fan shaft 42 have locating spigot surfaces 84. However, in addition, to further enhance torque transfer, the flanged connector and corresponding flanged portion 82 of the shaft have interlocking teeth 86 to form a curvic or Hirth coupling.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

All references referred to above are hereby incorporated by reference.

The invention claimed is:

1. A fan disc for supporting fan blades of a gas turbine engine, the fan disc having:

a disc body having axially extending slots for receiving, in use, dovetail root fixings of a circumferential row of fan blades, flanks of the axially extending slots being defined by dovetail root fingers extending from a radially outer side of the disc body; and an annular drive arm which extends radially inwardly from a forward portion of the disc body to a connector for engaging, in use, with a corresponding connector portion of a drive shaft of the engine;

wherein the fan disc further has a hoop stiffening ring which is removably mounted to a rear portion of the disc body, the hoop stiffening ring being axially spaced from the drive arm to increase the torsional stiffness of the fan disc: and wherein the hoop stiffening ring is mounted on and abuts a radially outward facing surface of the dovetail root fingers so as to provide extra support to the dovetail root fingers.

2. A fan disc according to claim 1, wherein the connector is a splined connector for engaging, in use, with a correspondingly splined connector portion of the drive shaft.

3. A fan disc according to claim 1, wherein the hoop stiffening ring is formed of composite material.

4. A fan disc according to claim 1, wherein:

the disc body has the dovetail root fingers; and the hoop stiffening ring projects radially outwardly beyond the outermost surfaces of the dovetail root fingers.

5. A fan disc according to claim 1, wherein the disc body has an aft portion which projects rearwardly of the rear ends of the dovetail root fixings of the fan blades, the hoop stiffening ring being removably mounted to an outer side of the aft portion.

6. A fan disc according to claim 1, wherein:

the disc body has the dovetail root fingers; and the disc body has an aft portion formed by a circumferential row of radially outward projections from rear ends of the dovetail root fingers, the hoop stiffening ring being removably mounted to a rear side of the aft portion.

7. A fan disc according to claim 5, wherein the hoop stiffening ring is removably mounted to the aft portion by a row of bolts threaded into axially extending bolt holes formed in the aft portion.

8. A fan disc according to claim 1 which further has an annular seal panel attached to or integrally formed with the hoop stiffening ring, the seal panel extending from the hoop stiffening ring to a radially-outward air-washed portion of the seal panel adjacent the trailing edges of the fan blades.

9. A fan disc according to claim 1, wherein the hoop stiffening ring has a row of forward facing support formations which, in use, support corresponding engagement portions of a row of annulus fillers located in the gaps between adjacent fan blades.

10. A gas turbine engine having a circumferential row of fan blades supported by the fan disc of claim 1, the axially extending slots of the fan disc receiving dovetail root fixings of the fan blades, and the connector of the drive arm of the fan disc engaging with a corresponding connector portion of a fan drive shaft of the engine.

11. A gas turbine engine according to claim 10 which further has a front bearing arrangement radially locating and supporting the fan drive shaft, the front bearing arrangement having a front bearing housing and a set of rotatable bearing members which is positioned in the housing axially between the connector portion and the hoop stiffening ring.

12. A gas turbine engine according to claim 11 which is a geared turbofan engine, the drive shaft being split into a front portion which provides the connector portion and a rear portion which connects to a low-pressure turbine of the engine, the front and rear portions being operatively connected to each other via a power gearbox, wherein the gearbox is located in the front bearing housing.

* * * * *